US007694438B1

(12) United States Patent
Christensen et al.

(10) Patent No.: US 7,694,438 B1
(45) Date of Patent: Apr. 13, 2010

(54) ARTICLE OF FOOTWEAR HAVING AN ADJUSTABLE RIDE

(75) Inventors: Brian Christensen, Centerville, MA (US); Paul M. Davis, Blackstone, MA (US); Todd Ellis, Boston, MA (US); Paul Litchfield, Westboro, MA (US); William Marvin, Brighton, MA (US)

(73) Assignee: Reebok International Ltd., Canton, MA (US)

( * ) Notice: Subject to any disclaimer, the term of this patent is extended or adjusted under 35 U.S.C. 154(b) by 735 days.

(21) Appl. No.: 11/610,382

(22) Filed: Dec. 13, 2006

(51) Int. Cl.
*A43B 13/20* (2006.01)

(52) U.S. Cl. ..... 36/29

(58) Field of Classification Search ..... 36/29, 36/88, 91, 153, 154, 35 B
See application file for complete search history.

(56) References Cited

U.S. PATENT DOCUMENTS

| | | | |
|---|---|---|---|
| 508,034 | A | 11/1893 | Moore |
| 547,645 | A | 9/1895 | MacDonald |
| 566,422 | A | 8/1896 | Singleton |
| 580,501 | A | 4/1897 | Mobberley |
| 586,155 | A | 7/1897 | Bascom |
| 850,327 | A | 4/1907 | Tauber |
| 1,069,001 | A | 7/1913 | Guy |
| 1,148,376 | A | 7/1915 | Gay |
| 1,193,608 | A | 8/1916 | Poulson |
| 1,198,476 | A | 9/1916 | Pearson |
| 1,304,915 | A | 5/1919 | Spinney |
| 1,328,154 | A | 5/1920 | Jackerson |
| 1,498,838 | A | 6/1924 | Harrison, Jr. |
| 1,605,985 | A | 11/1926 | Rasmussen |
| 1,954,122 | A | 4/1934 | Fiori |
| 1,979,972 | A | 11/1934 | Guild |
| 2,007,803 | A | 7/1935 | Kelly |
| 2,020,240 | A | 11/1935 | Cochran |
| 2,036,695 | A | 4/1936 | Heigis |
| 2,080,469 | A | 5/1937 | Gilbert |
| 2,080,499 | A | 5/1937 | Nathansohn |
| 2,177,116 | A | 10/1939 | Persichino |
| 2,488,382 | A | 11/1949 | Davis |
| 2,532,742 | A | 12/1950 | Stoiner |
| 2,600,239 | A | 6/1952 | Gilbert |
| 2,605,560 | A | 8/1952 | Gouabault |

(Continued)

FOREIGN PATENT DOCUMENTS

| | | |
|---|---|---|
| BR | 8305004 | 9/1983 |

(Continued)

*Primary Examiner*—Ted Kavanaugh
(74) *Attorney, Agent, or Firm*—Sterne, Kessler, Goldstein & Fox P.L.L.C.

(57) ABSTRACT

An article of footwear has an upper and a sole. The sole has an upper sole member, a lower sole member, and at least one inflatable bladder disposed between the upper sole member and the lower sole member. The at least one inflatable bladder has an inflated state and a deflated state. A distance between the upper sole member and the lower sole member is greater in the inflated state than the deflated state. Varying the inflation of the inflatable bladder varies the amount of cushioning in the sole and the thickness of the sole so that the shoe can serve as a multipurpose shoe for activities requiring different amounts of cushioning, such as a training shoe and a racing flat.

40 Claims, 17 Drawing Sheets

U.S. PATENT DOCUMENTS 2,638,690 A 5/1953 Bullard, III
2,677,904 A 5/1954 Reed
2,682,712 A * 7/1954 Owsen et al. ..... 36/107
2,686,081 A 8/1954 Cooksley
2,717,100 A 9/1955 Engelder
2,774,152 A 12/1956 Alber
2,863,230 A 12/1958 Cortina
2,981,010 A 4/1961 Aaskov
3,015,414 A 1/1962 Wilson
3,027,659 A 4/1962 Gianola
3,044,190 A 7/1962 Urbany
3,068,494 A 12/1962 Pinkwater
3,120,712 A 2/1964 Menken
3,221,932 A 12/1965 Anderson
3,225,463 A 12/1965 Burnham
3,331,146 A 7/1967 Karras
3,372,495 A 3/1968 Finn
3,410,004 A 11/1968 Finn
3,664,043 A 5/1972 Polumbus, Jr.
3,685,176 A 8/1972 Rudy
3,716,930 A 2/1973 Brahm
3,744,159 A 7/1973 Nishimura
3,760,056 A 9/1973 Rudy
3,854,228 A 12/1974 Conroy
3,973,336 A 8/1976 Ahn
3,995,653 A 12/1976 Mackal et al.
4,014,048 A 3/1977 Rappleyea
4,106,222 A 8/1978 Houck
4,129,951 A 12/1978 Petrosky
4,169,353 A 10/1979 Fresard
4,217,705 A 8/1980 Donzis
4,219,945 A 9/1980 Rudy
4,232,459 A 11/1980 Vaccari
4,271,606 A 6/1981 Rudy
4,361,969 A 12/1982 Vermonet
4,397,104 A 8/1983 Doak
4,417,407 A 11/1983 Fukuoka
4,446,634 A 5/1984 Johnson et al.
4,458,430 A 7/1984 Peterson
4,462,171 A 7/1984 Whispell
4,571,853 A 2/1986 Medrano
4,610,099 A 9/1986 Signori
4,628,945 A 12/1986 Johnson, Jr.
4,662,087 A 5/1987 Beuch
4,662,412 A 5/1987 Swallert
4,670,995 A 6/1987 Huang
4,700,403 A 10/1987 Vacanti
4,702,022 A 10/1987 Porcher
4,730,403 A 3/1988 Walkhoff
4,744,157 A 5/1988 Dubner
4,760,651 A 8/1988 Pon-Tzu
4,763,426 A 8/1988 Polus et al.
4,776,110 A 10/1988 Shlang
4,805,601 A 2/1989 Eischen, Sr.
4,823,482 A 4/1989 Lakic
4,856,208 A 8/1989 Zaccaro
4,887,367 A 12/1989 Mackness et al.
4,906,502 A 3/1990 Rudy
4,910,889 A 3/1990 Bonaventure et al.
4,912,861 A 4/1990 Huang
D314,172 S 1/1991 Whitley, II
4,991,317 A 2/1991 Lakic
4,995,173 A 2/1991 Spier
5,025,575 A 6/1991 Lakic
5,074,765 A 12/1991 Pekar
5,083,581 A 1/1992 Jaw
5,113,599 A 5/1992 Cohen et al.
5,129,107 A 7/1992 Lorenzo
5,144,708 A 9/1992 Pekar
5,155,864 A 10/1992 Walker et al.
5,155,865 A 10/1992 Walker et al.
5,155,866 A 10/1992 Walker et al.
5,158,767 A 10/1992 Cohen et al.
5,181,279 A 1/1993 Ross
5,195,254 A 3/1993 Tyng
5,199,191 A * 4/1993 Moumdjian ..... 36/28
5,230,249 A 7/1993 Sasaki et al.
5,253,435 A 10/1993 Auger et al.
5,257,470 A * 11/1993 Auger et al. ..... 36/88
5,343,638 A 9/1994 Legassie et al.
5,351,710 A 10/1994 Phillips
5,353,525 A 10/1994 Grim
5,392,534 A 2/1995 Grim
5,406,661 A 4/1995 Pekar
5,406,719 A 4/1995 Potter et al.
5,416,988 A 5/1995 Potter et al.
5,444,926 A 8/1995 Allen et al.
5,638,565 A 6/1997 Pekar
5,692,321 A 12/1997 Holstine
5,740,619 A * 4/1998 Broder ..... 36/61
5,765,298 A 6/1998 Potter et al.
5,771,606 A 6/1998 Litchfield et al.
5,806,208 A 9/1998 French
5,815,951 A * 10/1998 Jordan ..... 36/61
5,893,219 A 4/1999 Smith et al.
5,987,779 A 11/1999 Litchfield et al.
6,014,823 A 1/2000 Lakic
6,134,812 A 10/2000 Voss
6,161,240 A 12/2000 Huang
6,195,914 B1 3/2001 Otis
6,237,251 B1 5/2001 Litchfield et al.
6,287,225 B1 9/2001 Touhey et al.
6,354,020 B1 3/2002 Kimball et al.
6,430,843 B1 8/2002 Potter et al.
6,505,420 B1 1/2003 Litchfield et al.
6,510,624 B1 * 1/2003 Lakic ..... 36/29
6,553,691 B2 4/2003 Huang
6,785,985 B2 9/2004 Marvin et al.
6,892,477 B2 5/2005 Potter et al.
6,988,329 B2 1/2006 Marvin et al.
7,047,670 B2 5/2006 Marvin et al.
7,051,456 B2 5/2006 Swigart et al.
7,152,343 B2 * 12/2006 Whatley ..... 36/29
7,152,625 B2 12/2006 Marvin et al.
7,210,249 B2 5/2007 Passke et al.
2004/0211085 A1 10/2004 Passke et al.
2005/0028404 A1 2/2005 Marvin et al.
2005/0132617 A1 6/2005 Potter et al.
2006/0162186 A1 7/2006 Marvin et al.
2006/0272179 A1 12/2006 Passke et al.
2007/0084082 A1 4/2007 Dojan et al.
2007/0084083 A1 4/2007 Hazenberg et al.
2009/0235557 A1 9/2009 Christensen et al.

FOREIGN PATENT DOCUMENTS

DE 3427644 1/1986
EP 229273 7/1978
EP 40189 11/1981
EP 152401 8/1985
EP 184781 6/1986
EP 389215 9/1990
EP 472110 2/1992
EP 629360 12/1994
EP 630592 12/1994
FR 2496423 6/1982
GB 520514 12/1939
GB 2114425 8/1983
GB 2165439 4/1986
GB 2240254 7/1991
GB 2271710 4/1994
TW 95419 2/1989

| | | |
|---|---|---|
| WO | WO 87/03789 | 7/1987 |
| WO | WO 89/10074 | 11/1989 |
| WO | WO 90/04323 | 5/1990 |
| WO | WO 91/18527 | 12/1991 |
| WO | WO 93/14659 | 8/1993 |
| WO | WO 93/21790 | 11/1993 |

* cited by examiner

ARTICLE OF FOOTWEAR HAVING AN ADJUSTABLE RIDE

BACKGROUND OF THE INVENTION

1. Field of the Invention

This invention relates to footwear, and more particularly to an athletic shoe having an adjustable ride.

2. Background Art

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the stored energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

However, a cushioning device which is pressurized with fluid at the factory is comparatively expensive to manufacture. Further, pressurized fluid tends to escape from such a cushioning device, requiring large molecule fluids such as Freon gas to be used as the inflating fluid. A cushioning device which contains air at ambient pressure provides several benefits over similar devices containing pressurized fluid. For example, generally a cushioning device which contains air at ambient pressure will not leak and lose air, because there is no pressure gradient in the resting state.

Athletes, particularly runners, often have a pair of training shoes and a pair of racing flats. The training shoes are worn for every day training and are selected for their ample cushioning to prevent the injuries and ailments mentioned above. However, on race day, a runner typically wears a pair of racing flats, which have a comparatively thin sole in comparison to the training shoes and less cushioning to make the shoes lighter so that the wearer can run faster. Carrying around two pairs of shoes can be cumbersome and expensive. There is a need in the art to have a single shoe that can serve as both a training shoe and a racing flat.

BRIEF SUMMARY OF THE INVENTION

Disclosed herein is a sole for an article of footwear comprising an upper sole member, a lower sole member, and at least one inflatable bladder disposed between the upper sole member and the lower sole member. The at least one inflatable bladder has an inflated state and a deflated state. A distance between the upper sole member and the lower sole member is greater in the inflated state than the deflated state.

Also disclosed herein is an article of footwear comprising an upper and a sole. The sole comprises an upper sole member, a lower sole member, and at least one inflatable bladder disposed between the upper sole member and the lower sole member. The at least one inflatable bladder has an inflated state and a deflated state. A distance between the upper sole member and the lower sole member is greater in the inflated state than the deflated state.

BRIEF DESCRIPTION OF THE DRAWINGS/FIGURES

DETAILED DESCRIPTION OF THE INVENTION

Figure 1:
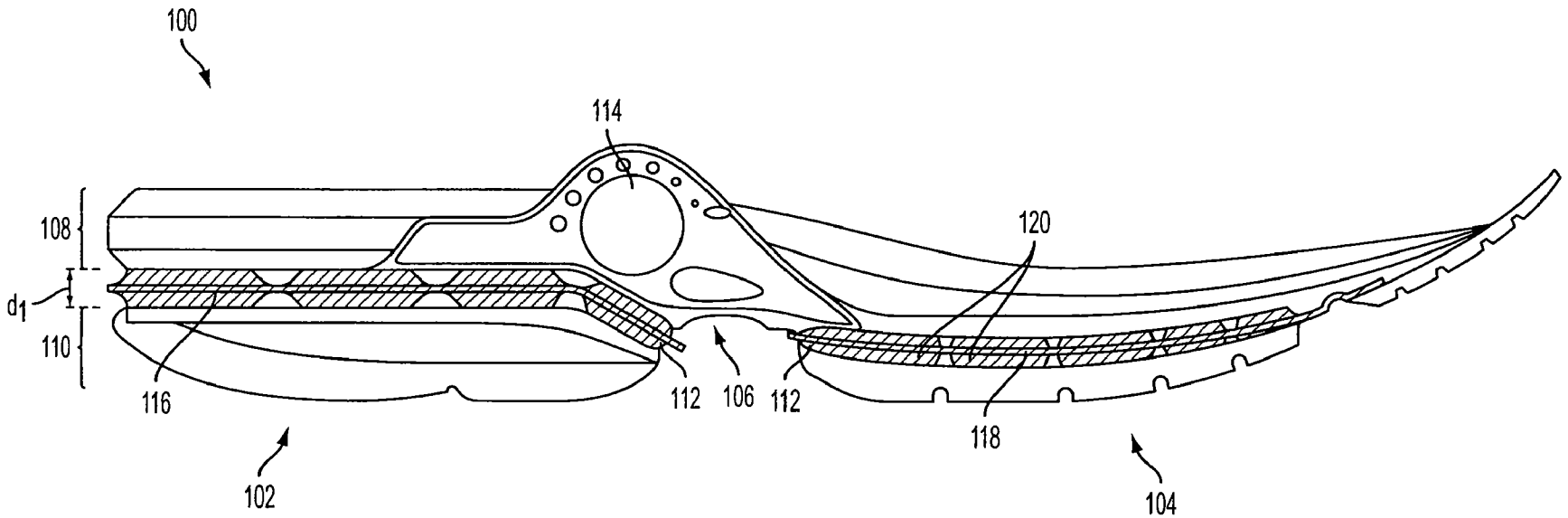
FIG. 1 is a side view of an exemplary sole in an inflated state.

The present invention is now described with reference to the Figures, in which like reference numerals are used to indicate identical or functionally similar elements. Also in the Figures, the left most digit of each reference numeral corresponds to the Figure in which the reference numeral first appears. While specific configurations and arrangements can be used without departing from the spirit and scope of the invention, it will be apparent to a person skilled in the relevant art that this invention can also be employed in other applications.

Figure 2A:
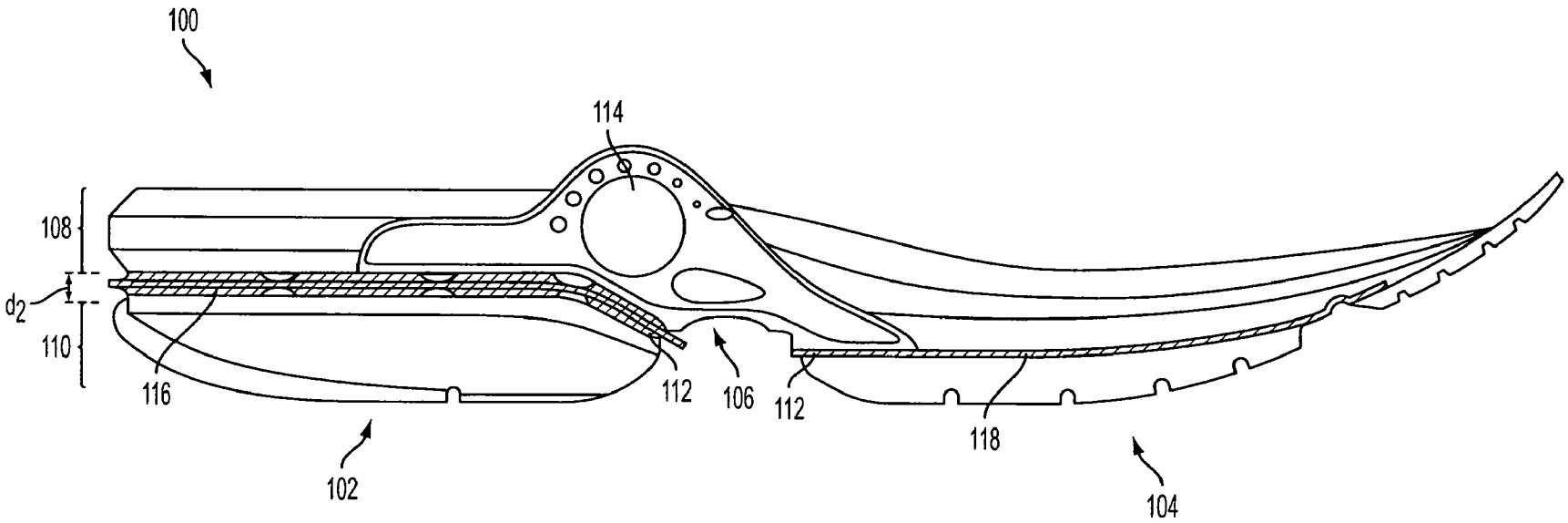
FIG. 2A is a side view of an exemplary sole in a deflated state wherein the bladders are visible.
Figure 2B:
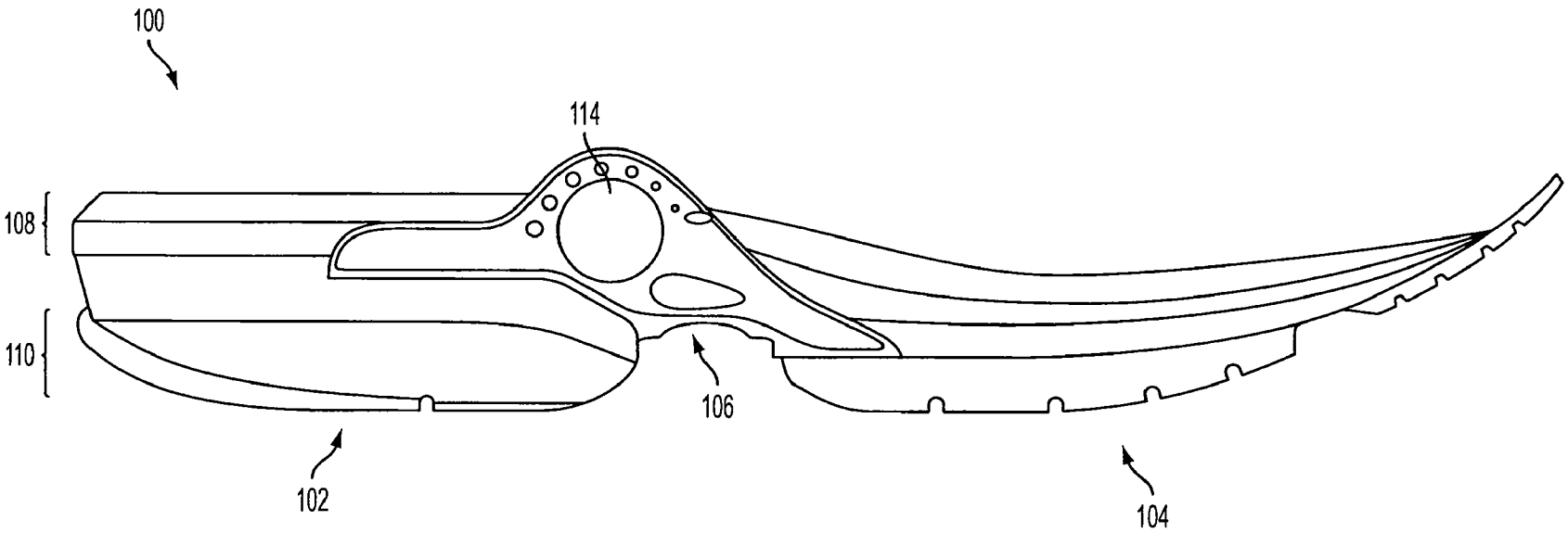
FIG. 2B is a side view of an exemplary sole in a deflated state wherein the bladders are not visible.

A sole of a shoe is shown generally at 100 in FIG. 1. Sole 100 is intended to be incorporated into any shoe including, without limitation, an athletic shoe, a brown shoe, sandal or a dress shoe by attaching it to an upper. As shown in FIG. 1, sole 100 has a heel area shown generally at 102, a forefoot area shown generally at 104 and an arch area shown generally at 106. Sole 100 has an upper sole member 108 and a lower sole member 110 with an inflatable bladder 112 located in between upper sole member 108 and lower sole member 110. Inflatable bladder 112 may be converted or adjusted between a deflated state as shown in FIGS. 2A and 2B and an inflated state as shown in FIG. 1. Inflating or deflating inflatable bladder 112 changes a thickness of sole 100 (or shoe) such that a distance $d_1$ between upper sole member 108 and lower sole member 110 is greater in the inflated state than a distance $d_2$ between upper sole member 108 and lower sole member 110 in the deflated state. In either the inflated state or the deflated state inflatable bladder 112 may be fully visible, partially visible or not visible in the assembly. As shown in FIG. 2A, the inflatable bladder may be visible. Alternatively, as shown in FIG. 2B, the inflatable bladder may not be visible in the deflated state because the inflatable bladder is stored in recesses in upper sole member 108 and/or lower sole member 110 and distance $d_2$ (not shown) is zero. The inflating and deflating action allows for an adjustable ride to the shoe, simulating a racing flat in the deflated state and a cushioned training shoe in the inflated state. It is noted that the distance between upper sole member 108 and lower sole member 110 may be different at different points along the sole. Sole 100 also has an air pressure regulator 114 that regulates the air pressure in inflatable bladder 112. Air pressure regulator 114 adjusts the pressure at which air is released from inflatable bladder 112 through a pressure release valve. Air pressure regulator 114 may be adjusted so the system is fully open (no air stays in inflatable bladder 112), regulated (pressure in inflatable bladder 112 varies depending on the setting, as air is allowed to purge through the pressure release valve above the set pressure threshold), or fully closed (inflatable bladder 112 inflates to a maximum inflation pressure and no air is allowed to pass through the pressure release valve).

The sole of the present invention has at least one inflatable bladder and can include a plurality of inflatable bladders such as a first inflatable bladder 116 for a heel area 102 and a second inflatable bladder 118 for a forefoot area 104. Alternatively, there may be a single inflatable bladder that spans substantially the entire sole. Other alternative embodiments with varying numbers and placements of inflatable bladders are also envisioned as would be readily apparent to a person of ordinary skill in the relevant art. Inflatable bladders may be fully visible, partially visible or not visible in the assembly in either the inflated state or the deflated state.

One skilled in the relevant art would readily appreciate that the type of inflatable bladder for use in the shoe of the present invention is not limited. One example of an inflatable bladder includes two films of monolayer or multilayer sealable thermoplastic material through which air may not readily pass. Furthermore, the two sealable thermoplastic films may be a multilayer laminate of film and fabric or of film and a nonwoven material. The two films utilized to form the inflatable bladder may be the same material or different materials such as a monolayer film and a multilayer laminate. The films of different materials may be cast or coextruded to form the inflatable bladder. An exemplary film includes an outer layer of 12 mil polyester urethane of 50 D Shore hardness, a scrim layer, and an inner layer of 8 mil polyester urethane of 95 A Shore hardness. The scrim layer is present to increase puncture resistance and to increase the tensile strength and its material may include, but is not limited to, 210 denier nylon of high tenacity or polyester. The outer layer material should be of suitable thickness and hardness to increase puncture resistance of the bladder. The inner layers face each other in an assembled inflatable bladder.

The films are sealed around a periphery to form the inflatable bladder. In a preferred embodiment the majority of the peripheral seal is on an inside of the inflatable bladder. Such an inflatable bladder can be made wherein the two films are positioned on top of each other and welded or otherwise sealed along a plurality of the peripheral edges leaving at least one peripheral edge unsealed. The two films are then turned inside out such that the seal is in the interior of the inflatable bladder. Then the remaining peripheral edge(s) is welded or otherwise sealed together to form the inflatable bladder.

Alternatively, the peripheral seal is on an outside of the inflatable bladder wherein the two films are positioned on top of each other and welded or otherwise sealed along the peripheral edges. The welding or sealing may include, but is not limited to, RF welding or heat sealing. Inflatable bladders can be shaped to have a plurality of interconnected inflatable chambers 120 as shown in FIG. 1 or a single chamber. A plurality of interconnected inflatable chambers can be formed by thermoforming the films and welding or otherwise sealing the films together at areas other than the periphery.

Upper sole member 108 and lower sole member 110 may be made from conventional materials as would be apparent to a person of ordinary skill in the relevant art, including, but not limited to, foam. Upper sole member 108 and lower sole member 110 may be formed using conventional means as would be apparent to a person of ordinary skill in the relevant art including, but not limited to, injection molding or compression molding. Upper sole member 108 and lower sole member 110 may each include one or more pieces.

Figure 3A:
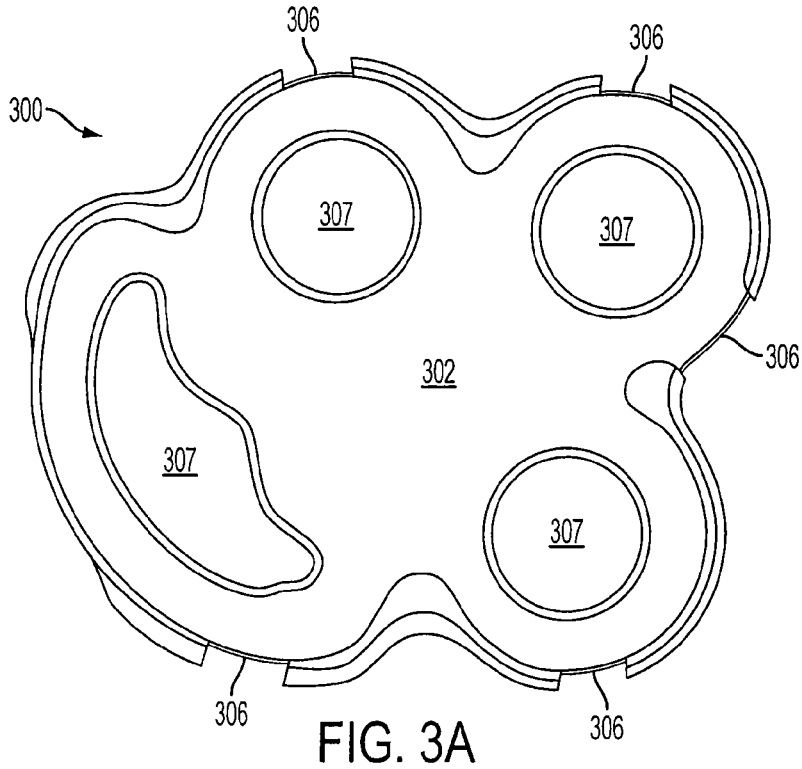
FIG. 3A is a top plan view of an exemplary lower sole member.

A lower surface of upper sole member 108 and an upper surface of lower sole member 110 may have recesses corresponding to a shape of a portion of the inflatable bladder located between the upper sole member 108 and lower sole member 110. The recesses aid in minimizing the thickness of sole 100 in the deflated state and locating inflatable bladder 112 between upper sole member 108 and lower sole member 110. FIG. 3A illustrates an exemplary lower sole member 300 having a recessed upper surface 302 and locating features 307 for mounting plates attached to inflatable bladder 112 to lower sole member 300. A lower surface of an upper sole member 108 would have a similar recessed lower surface and locating features as the upper surface of lower sole member 300 depicted in FIG. 3A.

Figure 3B:
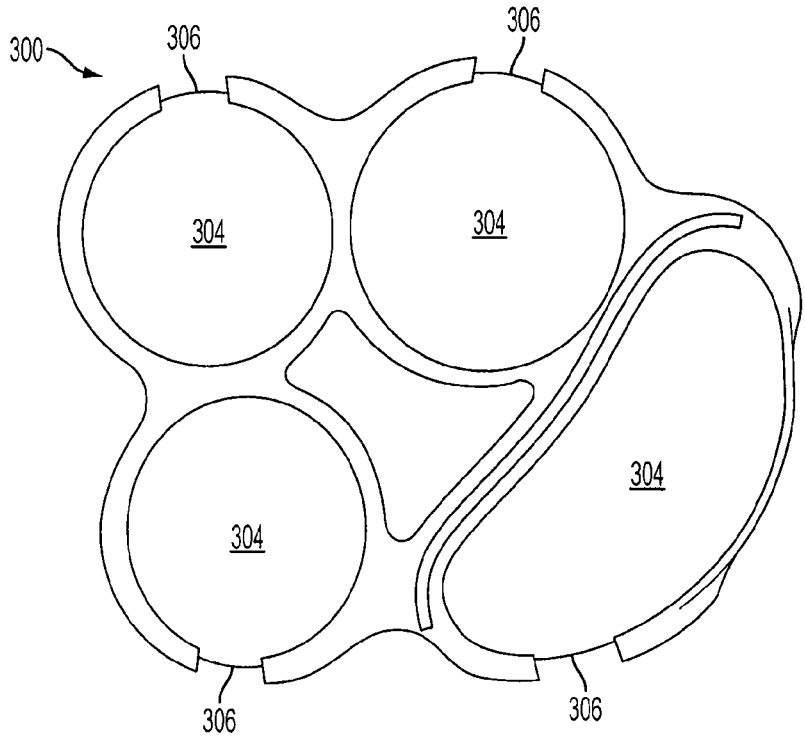
FIG. 3B is a bottom plan view of an exemplary lower sole member.
Figure 4A:
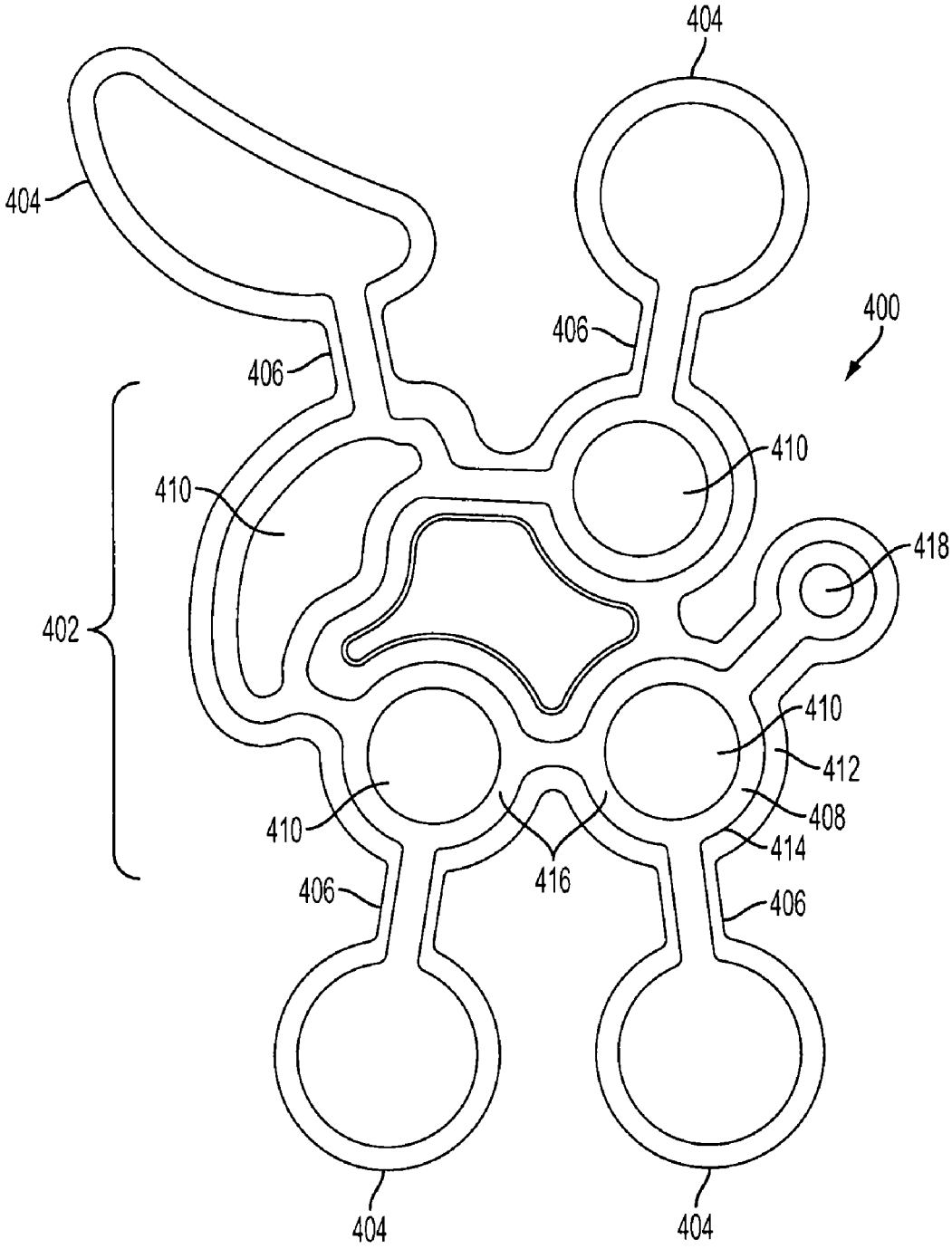
FIG. 4A is an exemplary inflatable heel bladder.
Figure 5A:
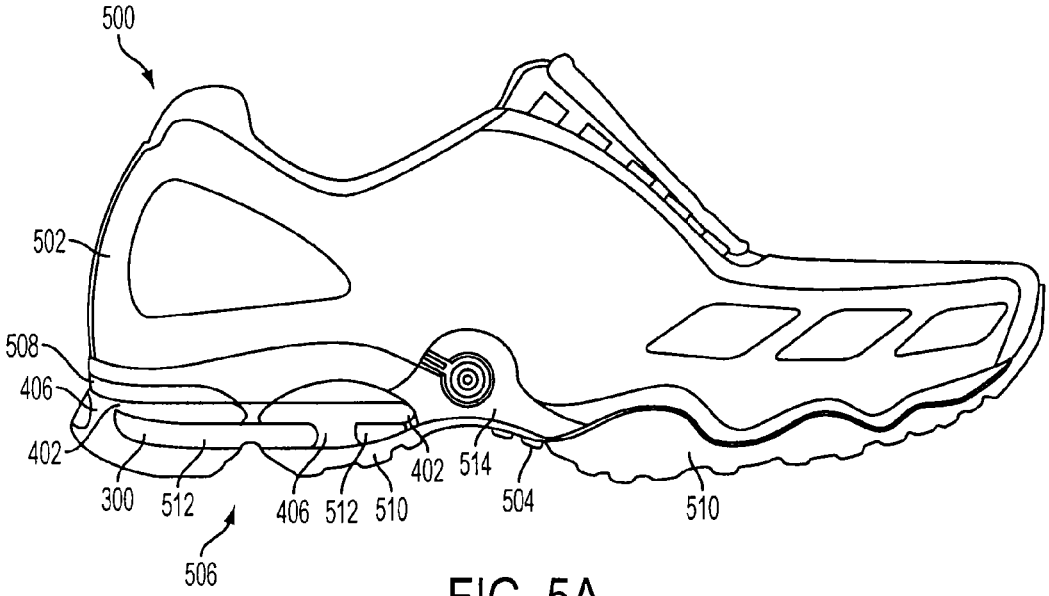
FIG. 5A is a side view of an exemplary shoe having the exemplary lower sole member of FIGS. 3A and 3B and the exemplary inflatable bladders of FIGS. 4A and 4B.
Figure 5B:
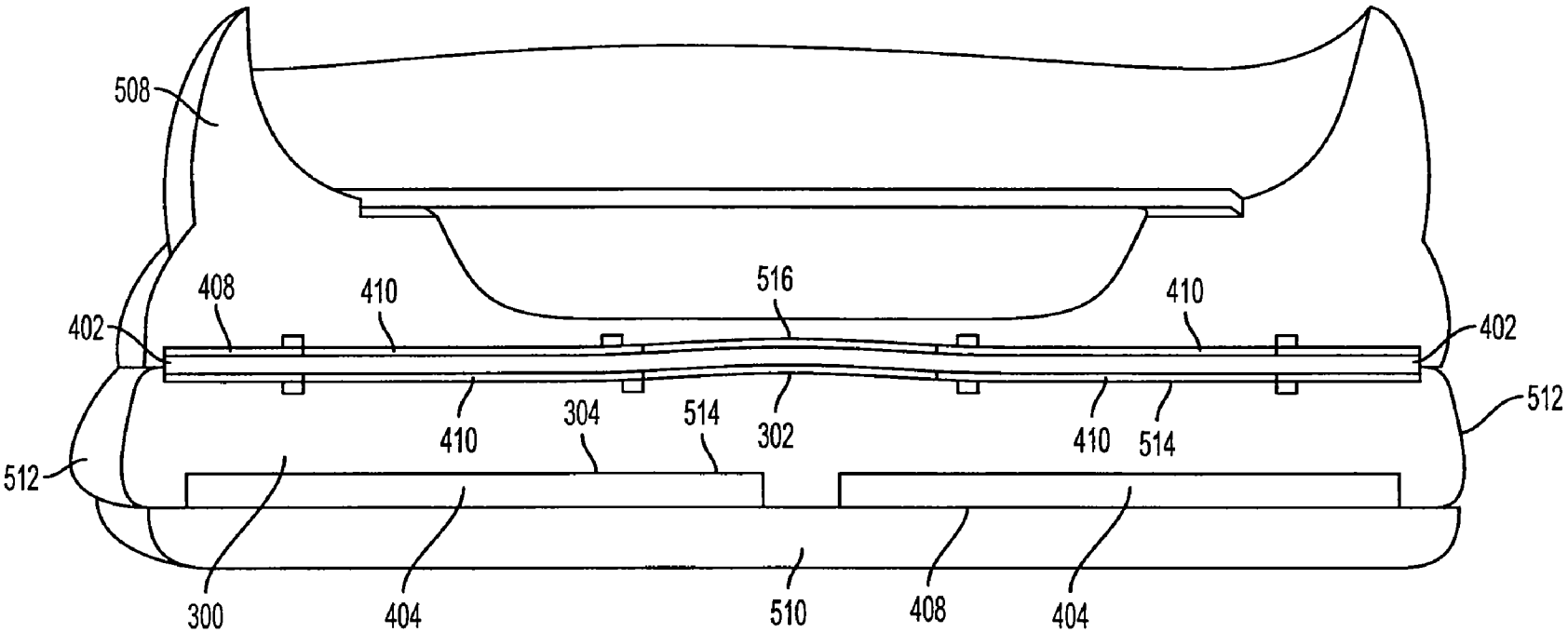
FIG. 5B is a cross-sectional view of a heel section of the exemplary shoe of FIG. 5A.

In one embodiment, at least one portion of the inflatable bladder folds over a side of the lower sole member and the at least one portion attaches to a lower surface of the lower sole member to provide stacked inflatable cushioning elements. FIGS. 3A and 3B depict an exemplary lower sole member 300 for a heel portion of a sole and FIG. 4A depicts an exemplary inflatable heel bladder 400 for a heel portion of a sole. FIGS. 5A and 5B depict an exemplary shoe 500 having an upper 502 and a sole 504. Sole 504 includes exemplary lower sole member 300 and exemplary inflatable bladder 400 assembled at the heel 506. Lower sole member 300 has a recessed upper surface 302, a recessed lower surface 304, and a side surface 512 connecting upper surface 302 and lower surface 304. The side surface has at least one groove 306. A groove 306 is located where a portion of inflatable bladder 400 folds over lower member 300.

Inflatable bladder 400 has a main portion 402 and peripheral portions 404. Main portion 402 has at least one inflatable chamber 416 and is fluidly connected to at least one peripheral portion 404 through extensions 406. Inflatable bladder 400 has a welding flange 412 with an inside edge 414 defining a boundary of inflatable chamber 416. Air may enter inflatable bladder 400 through a barb connector attached at a location 418. Main portion 402 is located between a lower surface 516 of an upper sole member 508 and upper surface 302 of lower sole member 300. Peripheral portions 404 fold over lower sole member 300 such that extensions 406 bend around grooves 306. Peripheral portions 404 are attached to lower surface 304 of lower sole member 300.

An outsole 510 may be placed over peripheral portions 404 of inflatable bladder 400 such that peripheral portions 404 are located between lower surface 304 of lower sole member 300 and outsole 510. The outsole material may be a lightweight, flexible, expandable material including, but not limited to, rubber or cast polyurethane, or a textile or suitable flexible substrate, that will expand to a profile of peripheral portions 404 when they are in an inflated state. The outsole material may also have treads or lugs formed thereon through direct injection, casting, cementing, or other known methods. Treads or lugs may also be directly attached to an inflatable bladder. Outsole 510 may also wrap up to side surface 512 of lower sole member 300 or extend beyond a gap between lower sole member 300 or upper sole member 508 and bond directly to upper sole member 508. Outsole 510 may also extend toward the leading edge or front edge of lower sole member 500 and connect to the shank 514.

Main portion 402 of inflatable bladder 400 has a first surface 408 that faces upper sole member 508 and a second surface 512 that faces lower sole member 300. First and second surfaces 408, 514 of main portion 402 of inflatable bladder 400 may be directly attached to lower surface 516 of upper sole member 508 or upper surface 302 of lower sole member 300, respectively. Alternatively, either first or second surface 408, 514 of main portion 402 may have one or more plates 410 attached thereto that are then attached to lower surface 516 of upper sole member 508 or upper surface 302 of lower sole member 300, respectively. Plates 410 may be a polymeric material, such as thermoplastic polyurethane. Plates 410 provide a mounting surface between inflatable bladder 400 and lower surface 516 of upper sole member 508 or upper surface 302 of lower sole member 300. Plates may also be located on first and second surfaces 408, 514 of peripheral portions 404 and bonded to lower surface 514 of lower sole member 300 and/or an inside surface of outsole material 510. It is noted that plates may also be located on first and second surfaces of the inflatable bladders depicted in FIGS. 1-2 as well and is not limited to the embodiment of inflatable bladder 400 with a main portion 402 and peripheral portions 404.

Plates 410 are strategically shaped, positioned, and made of suitable materials to control the profile of inflatable bladder 400 in its inflated state, to control the height of inflation, and locate inflatable bladder 400 between upper and lower sole members 508, 300. The greater the offset between an edge of plate 410 and an edge of inflatable bladder 400, the greater the thickness of inflation. The offset can also be varied to result in a tapered thickness or offset of inflation, either an increase in thickness or offset along a length of an inflatable bladder or a decrease in thickness along a length of an inflatable bladder. For example, the offset can be varied to result in less inflated thickness at a toe of a shoe and more inflated thickness as the forefoot region curves away from the toe.

When plates 410 are present on a surface of inflatable bladder 400, portions of the surface of inflatable bladder 400 not covered by plates 410 are preferably not attached to the upper sole member, the lower sole member, or anything else. This allows the unattached portions of the inflatable bladder to move away from the upper and lower sole members. However, there may be cases where it is preferred that an inflatable bladder be bonded to upper sole member 508, for example in the toe area or to an air transfer manifold 626.

Plates 410 are made from a polymeric material including, but not limited to, thermoplastic polyurethane. Plates 410 may be applied to inflatable bladder 400 through a variety of methods including, but not limited to, casting, silkscreen printing, or laminating through RF welding, direct injection or cold cementing. Another exemplary method for attaching plates 410 to inflatable bladder 400 includes applying a 3 mil film of low melting temperature adhesive film to a substrate of plate material, cutting out the formed assembly to a desired shape, and then affixing the adhesive side to the inflatable bladder through conventional methods including, without limitation, RF welding or heat pressing. Subsequently plates 410 may be cold cemented or otherwise attached to the upper sole member, lower sole member, or other surface.

Figure 4B:
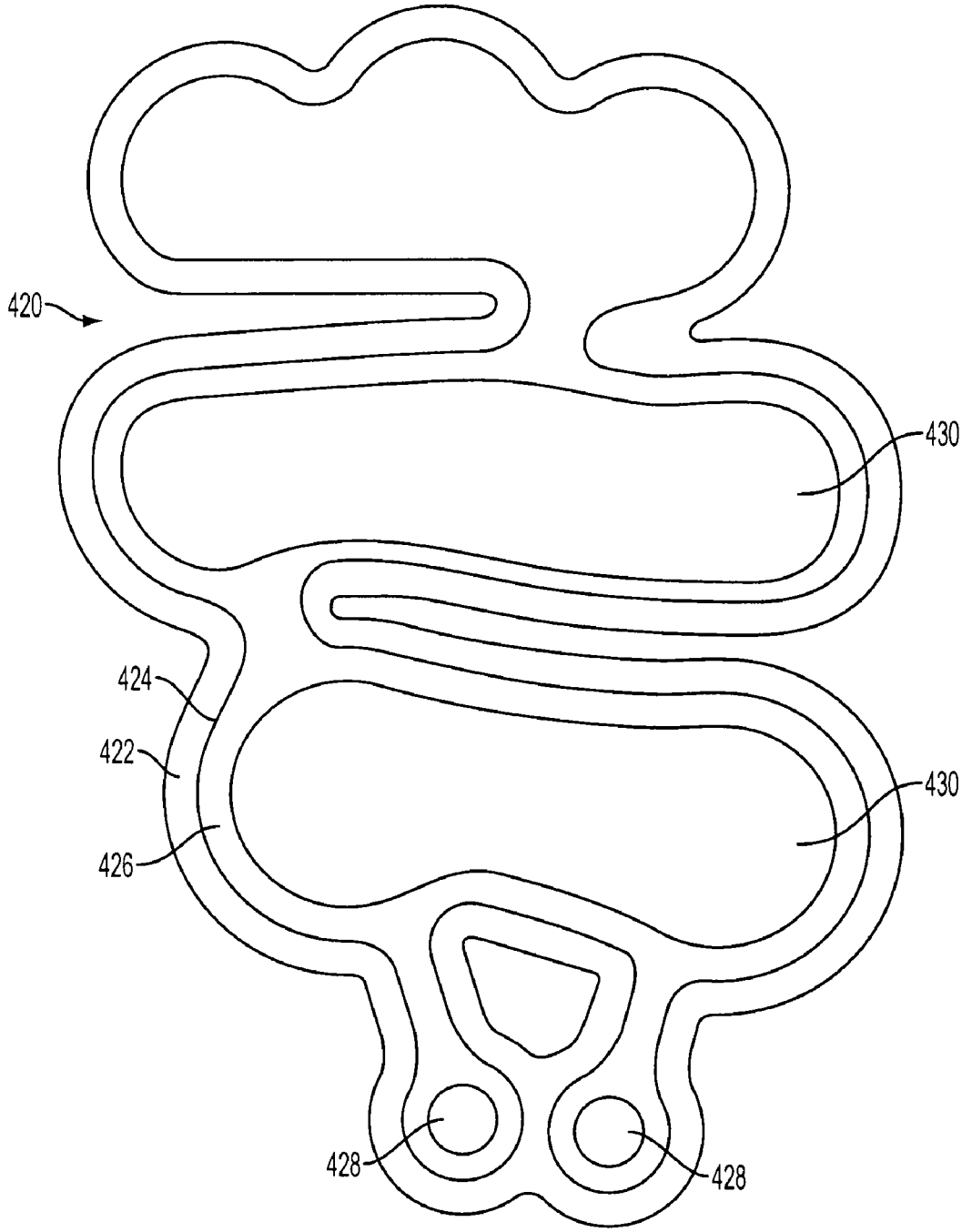
FIG. 4B is an exemplary inflatable forefoot bladder.

FIG. 4B shows an exemplary inflatable forefoot bladder 420. Inflatable bladder 420 has a welding flange 422 with an inside edge 424 defining a boundary of at least one inflatable chamber 426. Air may enter and leave inflatable forefoot bladder 420 through barb connectors attached at locations 428. Inflatable bladder 420 may also have plates 430 thereon. Plates 430 are similar to and serve the same function as plates 410 discussed above.

In an alternative embodiment, as best seen in FIGS. 12-16, an inflatable bladder 1400 may be a single film of thermoplastic material 1200 that is sealed or otherwise attached to a peripheral edge or other portion of a formed substrate 1300. Formed substrate 1300 may be formed through blow molding an article that is subsequently cut in half to create two mirror image formed substrates 1300. Formed substrate 1300 may be blow molded from a material such as thermoplastic polyurethane. Formed substrate 1300 may be molded to have a plurality of chambers 1302 connected through channels 1304. Inflatable bladder 1400 is inserted between an upper member 1502 and a lower member 1504 of sole 1500. As air enters inflatable bladder 1400, for example through a barb connector attached to film 1200 at a location 1204, film 1200 expands and increases the thickness of sole 1500.

Inflatable bladder 1400 is inserted between an upper member 1502 and a lower member 1504 of sole 1500 such that formed substrate 1300 sits in a cavity formed in upper surface 1608 of lower sole member 1504. Formed substrate 1300 may be cemented or otherwise attached to the cavity in upper surface 1608 of lower sole member 1504. Alternatively, formed substrate 1300 may sit in a cavity formed in lower surface 1610 of upper sole member 1502. Film 1200 has an upper surface 1206 that faces a lower surface 1610 of upper sole member 1502. Upper surface 1206 of film 1200 may have a plurality of plates 1202 thereon for attaching film 1200 to lower surface 1610 of upper sole member 1502. Plates 1202 are similar to and serve the same function as plates 410 discussed above.

Figure 15:
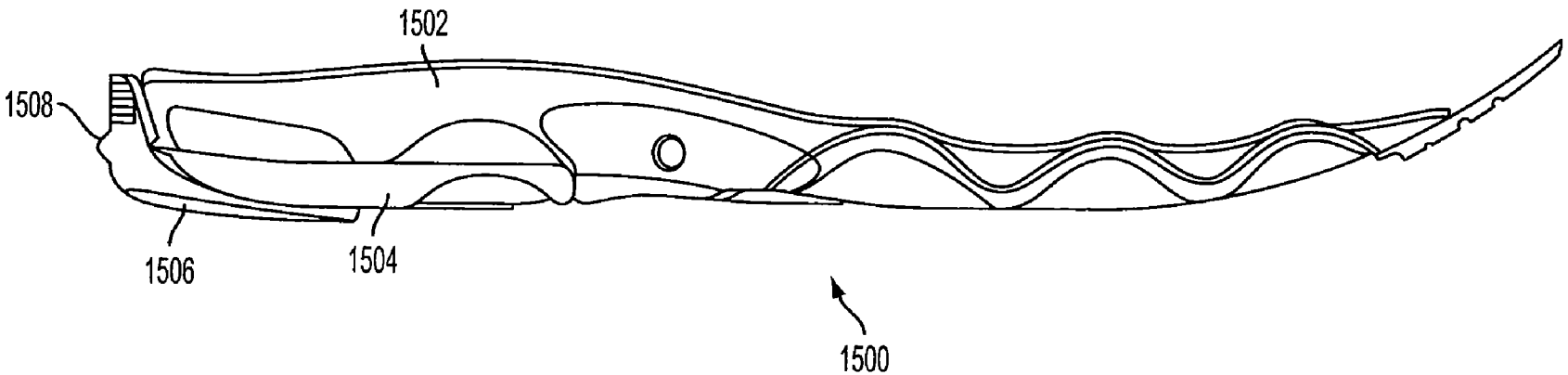
FIG. 15 is a side view of an exemplary sole having the exemplary inflatable bladder of FIG. 14 in the heel region and having an exemplary shear controlling member.
Figure 16:
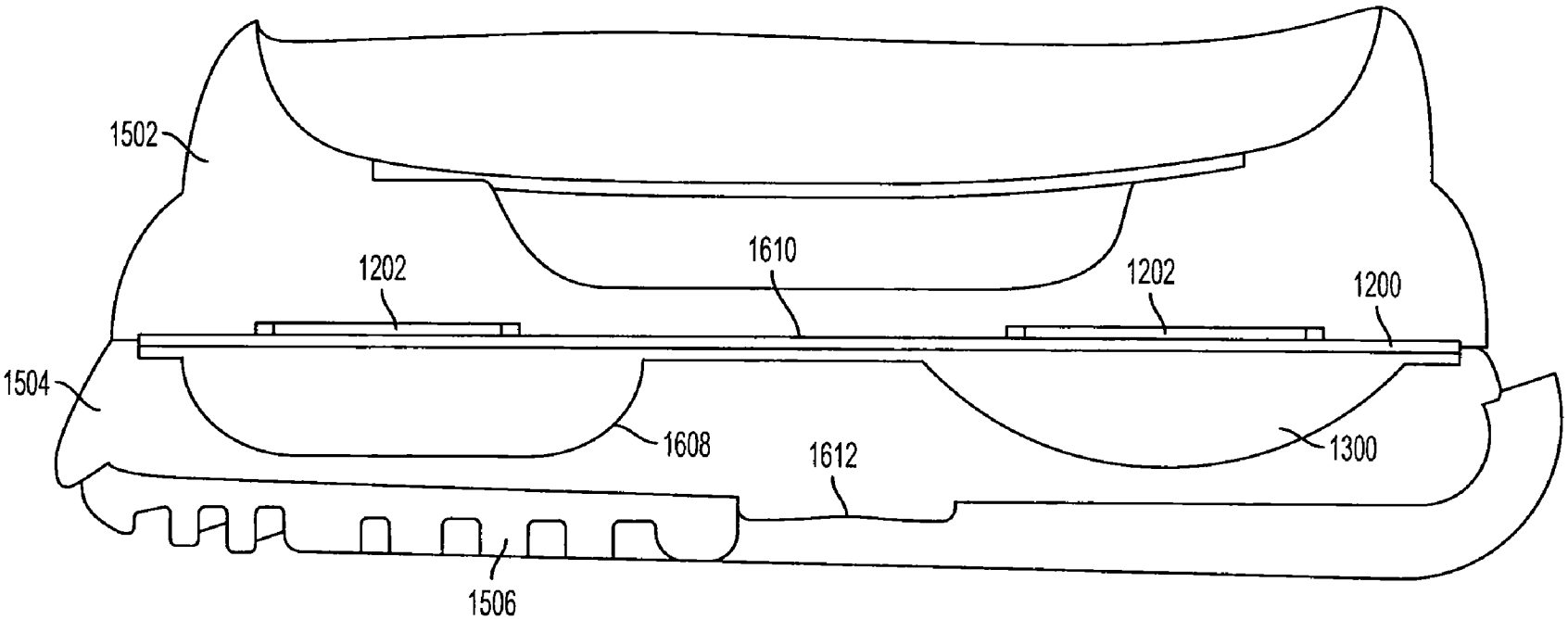
FIG. 16 is a cross-sectional view of a heel section of the exemplary shoe of FIG. 15.

The shoes and soles disclosed herein may have a shear controlling member that controls shear stress between an upper sole member and a lower sole member. Such a shear controlling member is shown in FIG. 15, but is merely exemplary and may be included in all embodiments of the shoes and soles disclosed herein. Sole 1500 has a shear controlling member 1506 that is attached to a lower surface 1612 of lower sole member 1504 and wraps around the heel of sole 1500 and attaches to upper sole member 1502. Material for shear controlling member 1506 may include, without limitation, a flexible rubber. Shear controlling member 1506 has a flexible portion 1508 that flexes as the sole is inflated and deflated. Shear controlling member 1506 provides additional structure to control shear stress and restrict relative movement between upper sole member 1502 and lower sole member 1504.

Figure 6:
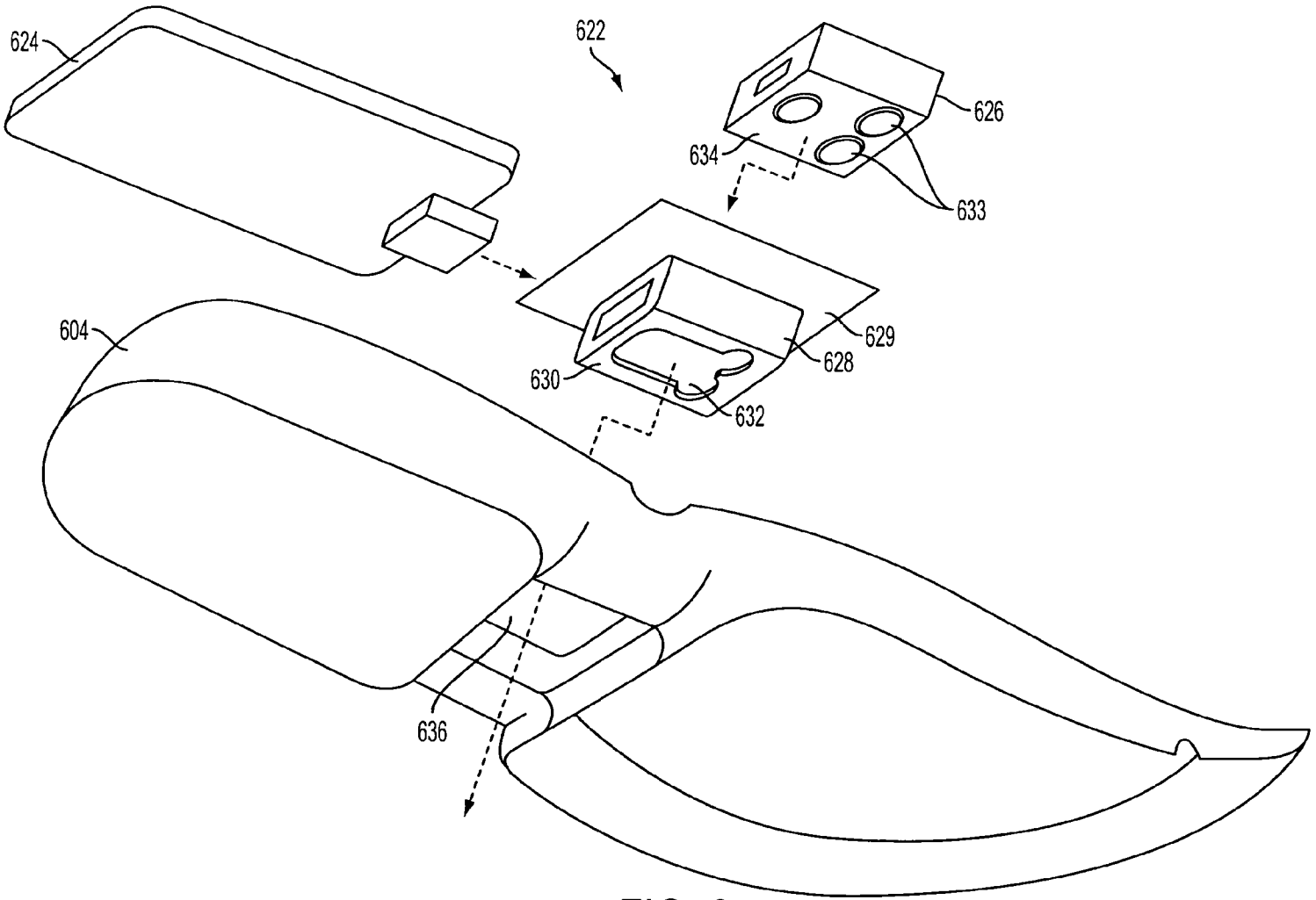
FIG. 6 is an exploded view of an exemplary inflation mechanism and air transfer manifold incorporated into a sole.
Figure 7:
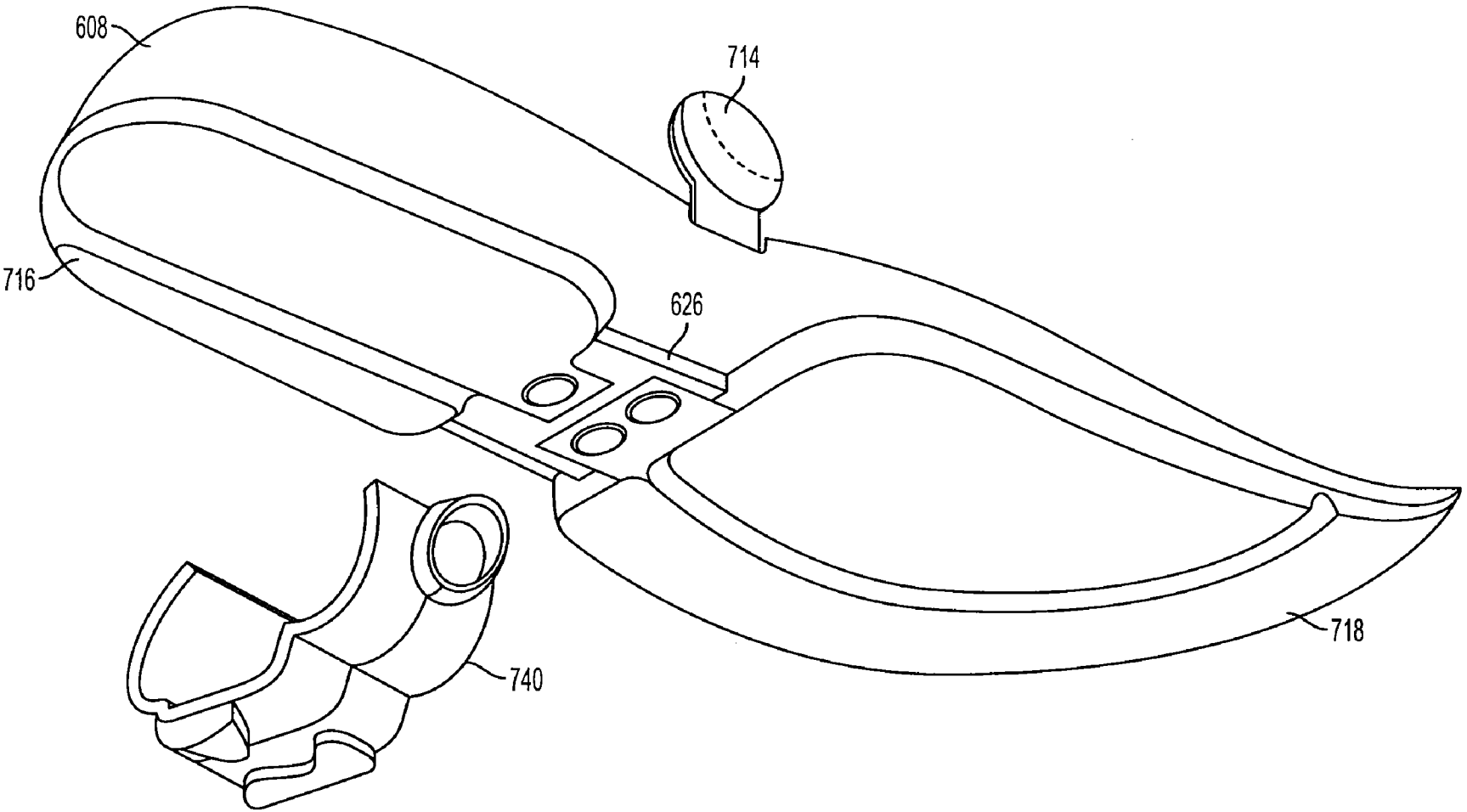
FIG. 7 is an exploded view of a an exemplary air pressure regulator incorporated into a sole.
Figure 8:
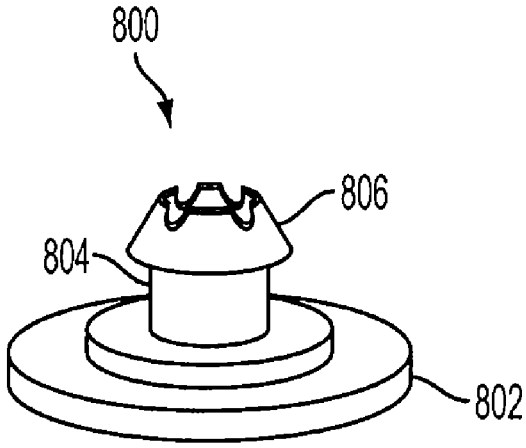
FIG. 8 is a perspective side view of an exemplary barb connector.

In order for a wearer to customize the amount of air in a bladder, the bladder is placed in fluid communication with an inflation mechanism and an air pressure regulator. FIGS. 6-7 illustrate an exemplary arrangement of an inflation mechanism generally shown at 622. Inflation mechanism 622 consists of an underfoot pump 624 fluidly connected to an air transfer manifold 626, which sits in a manifold seating 628. Preferably underfoot pump 624, manifold seating 628 and manifold 626 are injection molded from a polymeric material including, but not limited to, thermoplastic polyurethane, although other methods of formation may be used, as would be apparent to a person of ordinary skill in the relevant art. Manifold seating 628 has a bottom surface 630 with an opening 632 that allows access to a plurality of openings 633 in bottom surface 634 of manifold 626. Underfoot pump 624 sits in an indentation (not shown) on the upper surface of upper sole member 608. It is noted that while underfoot pump 624 is shown located in a heel region, it may be located anywhere along the top of upper sole member 608 or under upper sole member 608. Upper sole member 608 has an opening 636 for receiving manifold 626 and manifold seating 628 such that a flange 629 of manifold seating 628 prevents manifold 626 and manifold seating 628 from falling through opening 636. Alternatively, manifold 626 may have a peripheral flange that rests against an upper surface of upper sole member 608 to prevent manifold 626 from falling through opening 636, thereby eliminating the need for manifold seating 628. A bottom surface 634 of manifold 626 and manifold seating 628 are flush with opening 636 in upper sole member 608. Openings 633 on bottom surface 634 of manifold 626 are accessible for receiving barb connectors, as shown generally at 800 in FIG. 8, of bladders to fluidly connect the inflatable bladders to underfoot pump 624 via manifold 626. Barb connector 800 has a flange 802, a body 804 extending from flange 802, and at least one conical barb 806 at an end of body 804 opposite flange 802.

As shown in FIG. 7, inflatable bladder 716 and inflatable bladder 718 are fluidly connected to openings 633 in bottom surface 634 of manifold 626 via a barb connector 800 or other means. The bladder arrangement illustrated in FIG. 7 is merely exemplary and alternative arrangements such as a single bladder or any other arrangement that would have been apparent to a person of ordinary skill in the relevant art are also envisioned.

Air enters inflation mechanism 622 through an air intake hole (not shown) in underfoot pump 624 and passes through a one-way valve (not shown) into manifold 626 when underfoot pump 624 is compressed. The one-way valve prevents air from flowing back into underfoot pump 624. Manifold 626 has one or more pathways that direct the air into bladders 716, 718, thereby inflating them. The pathways may include flow restrictors locate therein or adjacent entrances to the pathways that limit the airflow to prevent an inflatable heel bladder from being inflated too quickly, thereby eliminating tears in the bladder, and reducing backflow pressures.

Figure 9:
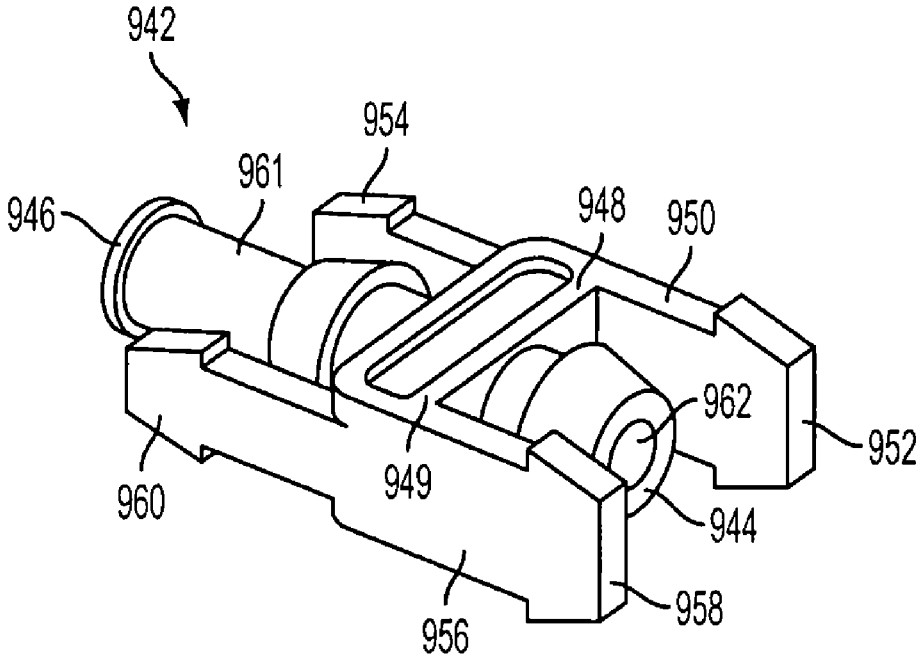
FIG. 9 is a perspective view of an exemplary one-way valve for use in an exemplary inflation mechanism.

An exemplary one-way valve is shown generally at 942 in FIG. 9. One-way valve 942 is preferably a molded piece of a smooth, nonporous material including, but not limited to, polycarbonate that is inserted between underfoot pump 624 and manifold 626. One-way valve 942 is generally cylindrical in shape and has a first end 944 and a second end 946. A first extension 948 and a second extension 949 extend perpendicularly from an axis of the body of one-way valve 942 on opposite sides from each other. A first connector arm 950 with a first end 952 and a second end 954 extends from first extension 948 substantially parallel to the cylindrical body and a second connector arm 956 with a first end 958 and a second end 960 extends from second extension 949 substantially parallel to the cylindrical body. There is at least one outlet air opening (not shown) along a circumference of the cylindrical body adjacent second end 946 of one-way valve 942. An elastomeric sleeve 961 surrounds the outlet opening adjacent second end 946. First end 944 of one-way valve 942, first end 952 of first connector arm 950 and first end 958 of second connector arm 956 are inserted into an air fitment receptacle (not shown) of underfoot pump 924 such that first and second extensions 948, 949 abut the air fitment receptacle. Second end 946 of one-way valve 942, second end 954 of first connector arm 950 and second end 960 of second connector arm 956 are inserted into openings in manifold 626 such that manifold 626 abuts first and second extensions 948, 949.

When underfoot pump 624 is compressed, air flows into an opening 962 in first end 944 of one-way valve 942 and through the valve body to the outlet opening (not shown). The force of the air pushes against elastomeric sleeve 961 covering the outlet opening causing it to expand allowing air to escape out the outlet opening past elastomeric sleeve 961 and into manifold 626. When the pressure is released from underfoot pump 624, elastomeric sleeve 961 returns to its original, unexpanded state such that air cannot flow back into valve 942 or into underfoot pump 624.

Inflation mechanism 622 described above, is merely exemplary and a variety of other inflation mechanisms may be utilized in the present invention. The inflation mechanism may be an on-board inflation mechanism, for example, a latex bulb which is physically attached to a part of the sole/shoe. Alternatively, the inflation mechanism may be a molded plastic chamber or may be a hand held pump such as one which utilizes $CO_2$ gas to inflate a bladder. Alternatively, the inflation mechanism may be a portion of a monolithic bladder that is separated from the remainder of the bladder. The isolated portion fluidly communicates with the remainder of the bladder via a one-way valve. The one-way valve allows the isolated portion to act as an inflation mechanism. These alternative inflation mechanisms are described more fully, for example, in U.S. Pub. No. 2006/0162186, which is incorporated herein by reference.

Each inflation mechanism requires a one-way valve to be present between the inflation mechanism and the inflatable bladder so that once air enters the inflatable bladder it may not travel backwards into the inflation mechanism. Various types of one-way valves are suitable for use in conjunction with the various alternative inflation mechanisms such as that described in U.S. Pub. No. 2006/0162186, which is incorporated herein by reference.

The inflatable bladder inflated by the inflation mechanism may be fluidly connected to other inflatable bladders located throughout the shoe such that the inflation of one inflatable bladder may in turn inflate other inflatable bladders. Each inflatable bladder may have its own check valve and/or air pressure regulator.

FIG. 7 illustrates an embodiment wherein pressure regulator 714 is fluidly connected to bladders 716, 718 via manifold 626. A protective cover 740 covers and protects bottom surface 634 of manifold 626 and wraps around a medial or lateral side of upper sole member 603 to surround pressure regulator 714. The material for protective cover 740 may include, without limitation, thermoplastic polyurethane or glass-filled nylon. Pressure regulator 714 may comprise an adjustable knob for setting a desired pressure at which the inflatable bladder is to be maintained. The adjustable knob may be adjustable according to ordinary means including, but not limited to, rotating or sliding. For example, adjustment can be made over a pressure range of 0 to 20 psi. Additional air present in the system bleeds off when the desired pressure is present and pressure regulator 714 will not allow the bladder to be inflated beyond the desired pressure no matter how much a user attempts to inflate the shoe. Pressure regulator 714 may also contain a provision to allow the inflatable bladder to deflate completely or not inflate at all when the desired pressure is set to 0.0 psi or through actuation of an alternative air pressure regulator. A flip top could be used to access pressure regulator 714 as described in U.S. patent application Ser. No. 11/475,254, filed Jun. 27, 2006, which is incorporated herein by reference. The above described pressure regulator is merely exemplary and other air pressure regulators could be used, such as a release valve, a check valve or a combination check valve and release valve, as described in U.S. Pub. No. 2006/0162186, which is incorporated herein by reference.

Figure 10:
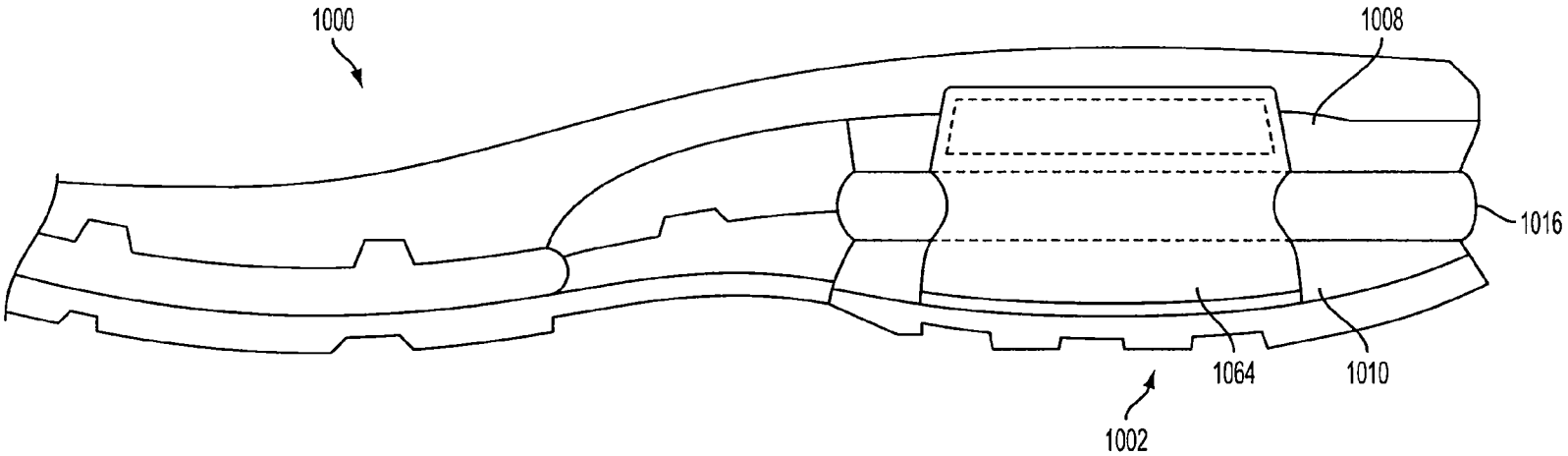
FIG. 10 is a side view of an exemplary sole with an exemplary stiffening member for medial posting.
Figure 11B:
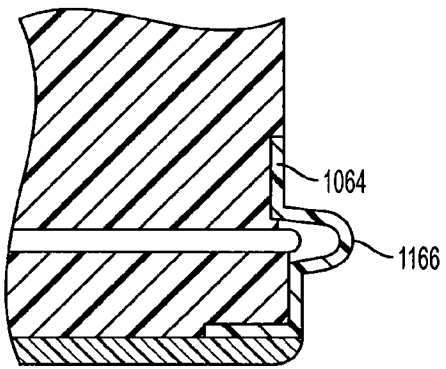
FIG. 11B is a section view of an exemplary sole with an exemplary medial anti-roll device in a deflated state.
Figure 11A:
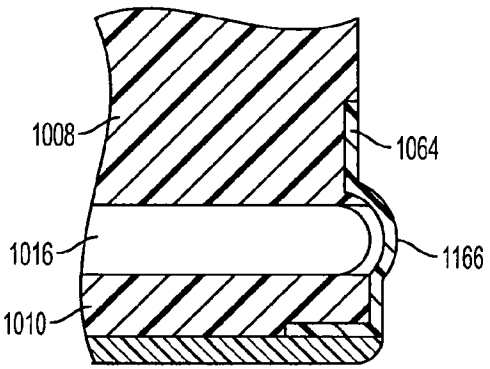
FIG. 11A is a section view of an exemplary sole with an exemplary medial anti-roll device in an inflated state.
Figure 12:
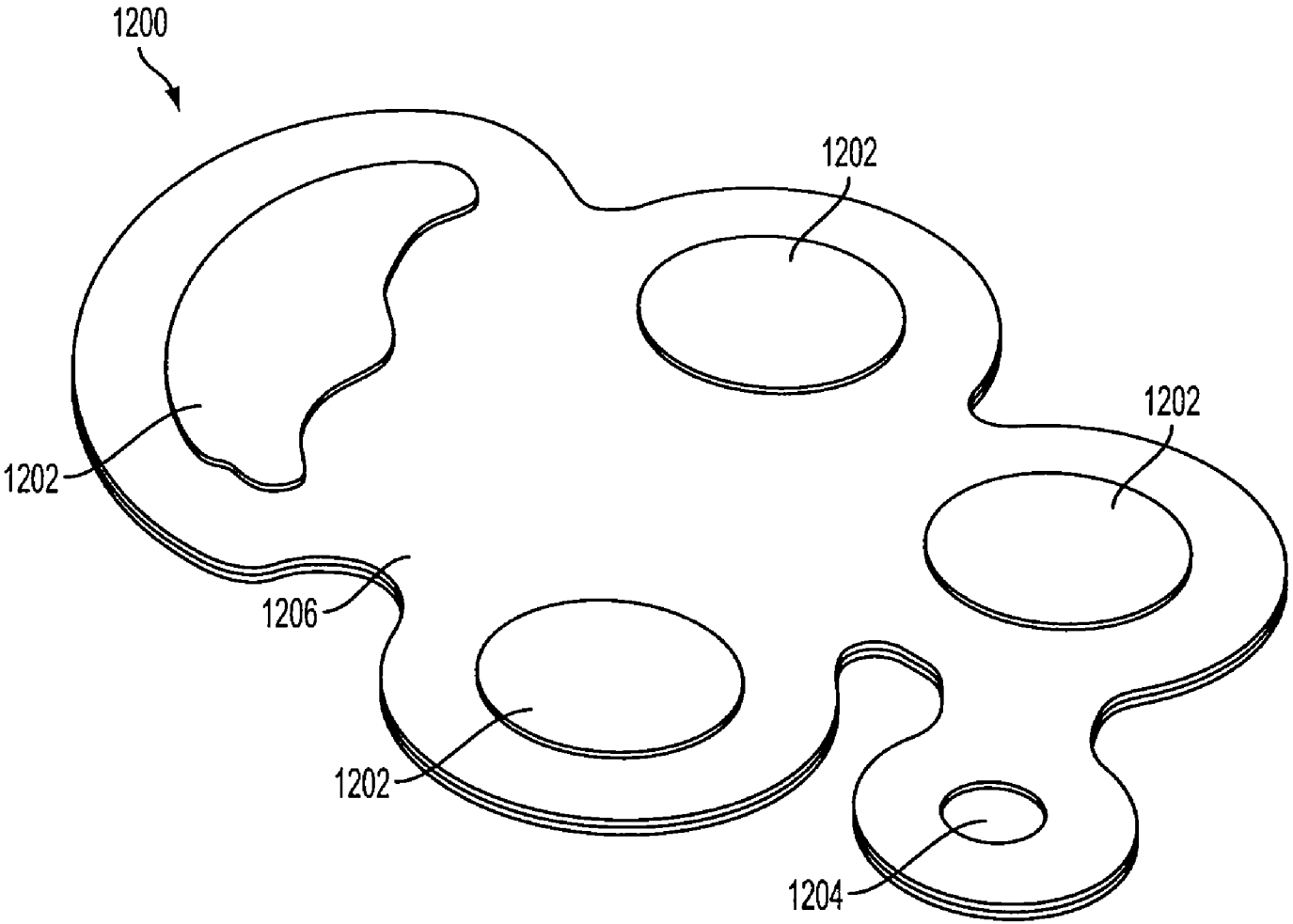
FIG. 12 is a perspective top view of an exemplary thermoplastic film for use in an exemplary inflatable bladder.
Figure 13:
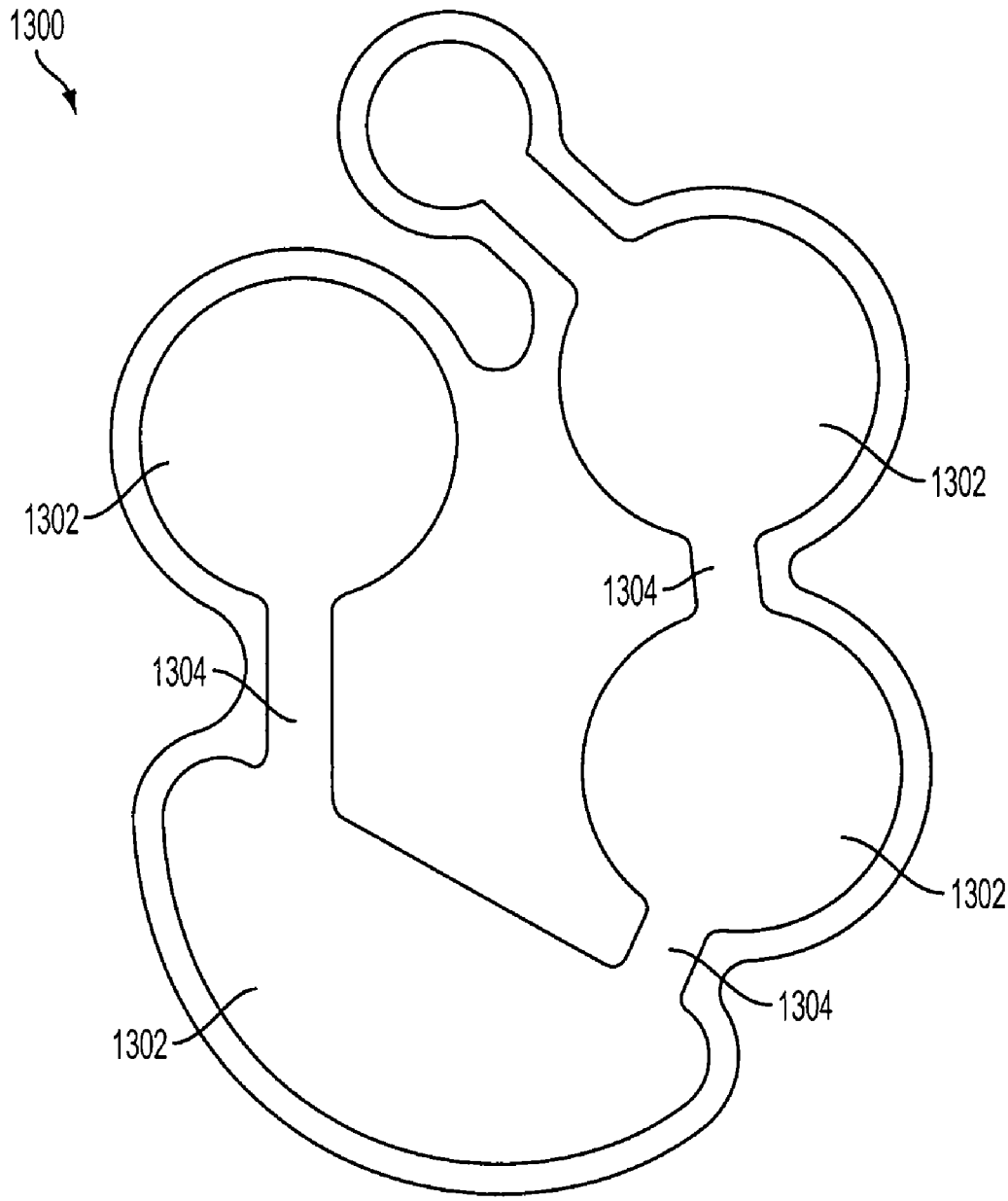
FIG. 13 is a perspective bottom view of an exemplary formed substrate for use in an exemplary inflatable bladder.
Figure 14:
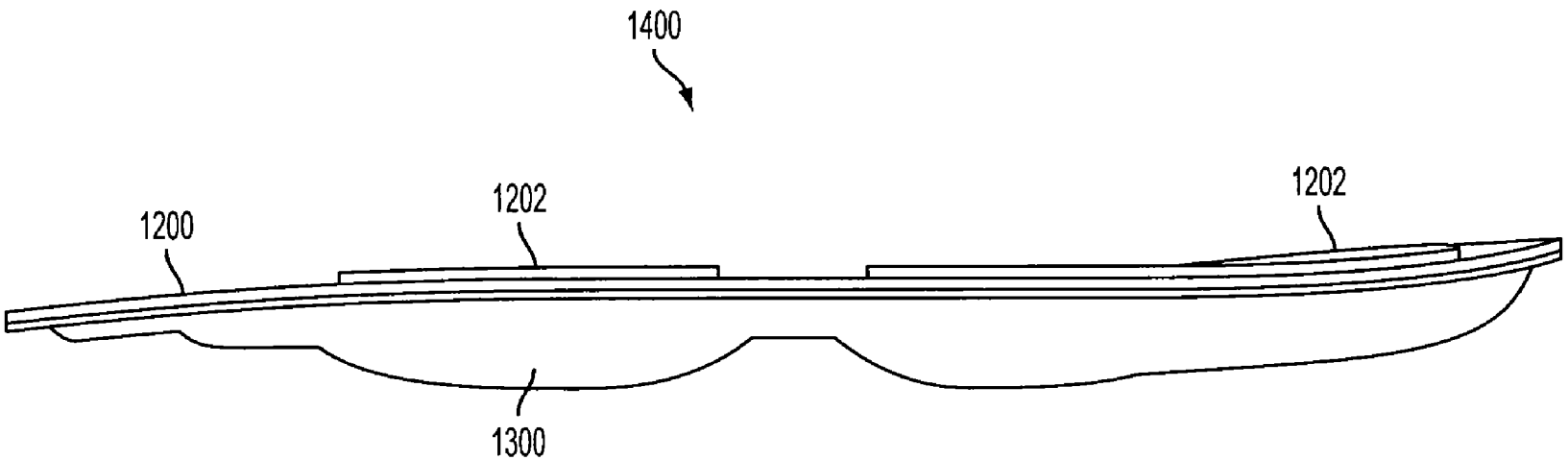
FIG. 14 is a side view of an exemplary inflatable bladder formed from the exemplary thermoplastic film of FIG. 12 and the exemplary formed substrate of FIG. 13.

In a preferred embodiment, the sole may have a stiffening member for medial posting attached to the medial side of the sole in a heel area as shown in FIGS. 10, 11A and 11B. Stiffening member 1064 is placed in a heel area 1002 of sole 1000 on the medial side in order to prevent the wearer's foot from rolling inwards while moving (pronation). Stiffening member 1064 is preferably attached to a portion of upper sole member 1008 and a portion of lower sole member 1010 and includes a flexible portion 1166 that flexes as the inflatable bladder 1016 is inflated and deflated. Stiffening member 1064 is preferably made of a flexible polymeric material, such as thermoplastic polyurethane, so it can adjust between an inflated state as shown in FIG. 11A and a deflated state as shown in FIG. 11B. The shape of stiffening member 1064 is merely exemplary and other shapes, as would be apparent to a person of ordinary skill in the relevant art that serve the same function could also be utilized as an alternative. The additional structure provided by stiffening member 1064 restricts the relative movement of upper sole member 1008 with respect to lower sole member 1010, so as to prevent excessive pronation. Stiffening member 1064 may also control relative shear between upper sole member 1008 and lower sole member 1010 and/or limit the overall inflation and/or deflation of inflatable bladder 1016.

A sole or a shoe incorporated with a sole disclosed herein allows the user to adjust the "ride" (cushioning sensation) of the sole/shoe from a state where the inflatable bladder(s) is deflated in a racing flat form to a state where the inflatable bladder(s) is fully inflated to provide maximum cushioning and any partially inflated state inbetween. Inflating the inflatable bladder increases the distance between the upper sole member and the lower sole member, thereby increasing the thickness of the sole and shoe. Conversely, deflating the inflatable bladder decreases the distance between the upper sole member and the lower sole member, thereby decreasing the thickness of the sole. The present invention can be carried out on the entire sole, or any portion or combination of portions thereof, such as a forefoot area or a heel area.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. A sole for an article of footwear, the sole comprising:

an upper sole member;

a lower sole member; and at least one inflatable bladder disposed between said upper sole member and said lower sole member wherein said at least one inflatable bladder has an inflated state and a deflated state and wherein a distance between said upper sole member and said lower sole member is greater in the inflated state than the deflated state, wherein said lower sole member has an upper surface, a lower surface and a side surface connecting said upper surface and said lower surface;

said at least one inflatable bladder has at least one portion that folds over said side surface of said lower sole member; and a first surface of said at least one inflatable bladder attaches to a lower surface of said lower sole member.

2. The sole of claim 1, wherein said at least one inflatable bladder further comprises:

a first inflatable bladder positioned in a forefoot area of said sole; and a second inflatable bladder positioned in a heel area of said sole.

3. The sole of claim 1, wherein said at least one inflatable bladder is positioned in a forefoot area of said sole.

4. The sole of claim 1, wherein said at least one inflatable bladder is positioned in a heel area of said sole.

5. The sole of claim 1, wherein said upper sole member comprises an opening for holding a manifold.

6. The sole of claim 1, further comprising an outsole attached to a second surface of said at least one portion of said at least one bladder.

7. The sole of claim 6, wherein said outsole is a flexible material such that when said at least one portion of said at least one bladder is in the inflated state a profile of said outsole expands to accommodate the inflated said at least one portion.

8. The sole of claim 7, wherein:

said upper sole member has a lower surface;

said lower surface of said upper sole member and said upper surface of said lower sole member are recessed to correspond to a shape of a portion of said at least one inflatable bladder located between said upper sole member and said lower sole member; and said lower surface of said lower sole member is recessed to correspond to a shape of said portion of said at least one inflatable bladder that is located between said lower sole member and said outsole.

9. The sole of claim 1, wherein said side surface has at least one groove located where said at least one portion of said inflatable bladder folds over said side surface.

10. The sole of claim 1, wherein:

said upper sole member has a recessed lower surface corresponding to a shape of said at least one inflatable bladder; and said lower sole member has a recessed upper surface corresponding to a shape of said at least one inflatable bladder.

11. The sole of claim 1, further comprising:

at least one plate having a first surface and a second surface wherein said first surface is attached to a lower surface of said upper sole member and said second surface is attached to a surface of said inflatable bladder.

12. The sole of claim 1, further comprising:

at least one plate having a first surface and a second surface wherein said first surface is attached to an upper surface of said lower sole member and said second surface is attached to a surface of said inflatable bladder.

13. The sole of claim 1, further comprising:

at least one first plate having a first surface and a second surface wherein said first surface is attached to a lower surface of said upper sole member and said second surface is attached to a first surface of said inflatable bladder; and at least one second plate having a first surface and a second surface wherein said first surface is attached to an upper surface of said lower sole member and said second surface is attached to a second surface of said inflatable bladder.

14. The sole of claim 1, wherein said at least one inflatable bladder comprises:

a formed substrate; and a film attached to a periphery of said formed substrate.

15. The sole of claim 14, wherein said formed substrate is blow molded.

16. The sole of claim 14, wherein said formed substrate is thermoplastic polyurethane.

17. The sole of claim 14, wherein:

said lower sole member has an upper surface with a cavity; and said formed substrate is adjacent said cavity.

18. The sole of claim 14, wherein:

said upper sole member has a lower surface with a cavity; and said formed substrate is adjacent said cavity.

19. An article of footwear comprising:

an upper; and a sole comprising:

an upper sole member;

a lower sole member; and at least one inflatable bladder disposed between said upper sole member and said lower sole member wherein said at least one inflatable bladder has an inflated state and a deflated state and wherein a distance between said upper sole member and said lower sole member is greater in the inflated state than the deflated state, wherein said lower sole member has an upper surface, a lower surface and a side surface connecting said upper surface and said lower surface;

said at least one inflatable bladder has at least one portion that folds over side surface of said lower sole member; and a first surface of said at least one inflatable bladder attaches to a lower surface of said lower sole member.

20. The article of footwear of claim 19, wherein said upper sole member has an opening.

21. The article of footwear of claim 20, further comprising:

a manifold located in said opening in said upper sole member wherein said at least one inflatable bladder is fluidly connected to said manifold; and an underfoot pump fluidly connected to said manifold that transfers air through said manifold and into said at least one inflatable bladder for inflating said at least one inflatable bladder.

22. The article of footwear of claim 21, further comprising:

an air pressure regulator.

23. The article of footwear of claim 22, where air pressure regulator regulates pressure in said at least one inflatable bladder and bleeds off air when the pressure meets a threshold value.

24. The article of footwear of claim 22, wherein said air pressure regulator is fluidly connected to said manifold.

25. The article of footwear of claim 19, wherein said at least one inflatable bladder comprises:

a first inflatable bladder positioned in a forefoot region of said sole; and a second inflatable bladder positioned in a heel region of said sole.

26. The article of footwear of claim 19, wherein said at least one inflatable bladder is positioned in a forefoot area of said sole.

27. The article of footwear of claim 19, wherein said at least one inflatable bladder is positioned in a heel area of said sole.

28. The article of footwear of claim 19, further comprising an outsole attached to a second surface of said at least one portion of said at least one bladder.

29. The article of footwear of claim 19, wherein said outsole is a flexible material such that when said at least one portion of said at least one bladder is in the inflated state a profile of said outsole expands to accommodate the inflated said at least one portion.

30. The article of footwear of claim 19, wherein said side surface has at least one groove located where said at least one portion of said inflatable bladder folds over said side surface.

31. The sole of claim 30, wherein:

said upper sole member has a lower surface;

said lower surface of said upper sole member and said upper surface of said lower sole member are recessed to correspond to a shape of a portion of said at least one inflatable bladder located between said upper sole member and said lower sole member; and said lower surface of said lower sole member is recessed to correspond to a shape of said portion of said at least one inflatable bladder that is located between said lower sole member and said outsole.

32. The article of footwear of claim 19, wherein said upper sole member has a recessed lower surface corresponding to a shape of said at least one inflatable bladder and wherein said lower sole member has a recessed upper surface corresponding to a shape of said at least one inflatable bladder.

33. The article of footwear of claim 19, further comprising:

at least one plate having a first surface and a second surface wherein said first surface is attached to a lower surface of said upper sole member and said second surface is attached to a surface of said inflatable bladder.

34. The article of footwear of claim 19, further comprising:

at least one plate having a first surface and a second surface wherein said first surface is attached to an upper surface of said lower sole member and said second surface is attached to a surface of said inflatable bladder.

35. The article of footwear of claim 19, further comprising:

at least one first plate having a first surface and a second surface wherein said first surface is attached to a lower surface of said upper sole member and said second surface is attached to a first surface of said inflatable bladder; and at least one second plate having a first surface and a second surface wherein said first surface is attached to an upper surface of said lower sole member and said second surface is attached to a second surface of said inflatable bladder.

36. The article of footwear of claim 19, wherein said at least one inflatable bladder comprises:

a formed substrate; and a film attached to a periphery of said formed substrate.

37. The article of footwear of claim 36, wherein said formed substrate is blow molded.

38. The article of footwear of claim 36, wherein said formed substrate is thermoplastic polyurethane.

39. The article of footwear of claim 36, wherein:

said lower sole member has an upper surface with a cavity; and said formed substrate is adjacent said cavity.

40. The article of footwear of claim 36, wherein:

said upper sole member has a lower surface with a cavity; and said formed substrate is adjacent said cavity.

* * * * *

UNITED STATES PATENT AND TRADEMARK OFFICE

CERTIFICATE OF CORRECTION

PATENT NO. : 7,694,438 B2
APPLICATION NO. : 11/610382
DATED : April 13, 2010
INVENTOR(S) : Christensen et al.

It is certified that error appears in the above-identified patent and that said Letters Patent is hereby corrected as shown below:

Title Page, Item [56]
In the References Cited section under U.S. Patent Documents, please insert --5,979,078 A 11/1999 Potter *et al*.--; and Col. 10, line 54, (claim 2, line 2), please delete "further"

Signed and Sealed this
Twenty-fifth Day of January, 2011

David J. Kappos

David J. Kappos
*Director of the United States Patent and Trademark Office*